US008668515B2

(12) United States Patent
Wu

(10) Patent No.: US 8,668,515 B2
(45) Date of Patent: Mar. 11, 2014

(54) ELECTRONIC MODULE WITH IMPROVED LATCH MECHANISM

(75) Inventor: Jerry Wu, Irvine, CA (US)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 47 days.

(21) Appl. No.: 13/349,899

(22) Filed: Jan. 13, 2012

(65) Prior Publication Data

US 2012/0190224 A1 Jul. 26, 2012

(30) Foreign Application Priority Data

Jan. 21, 2011 (CN) ..... 2011 1 0024055

(51) Int. Cl.
*H01R 13/627* (2006.01)

(52) U.S. Cl.
USPC ..... 439/352

(58) Field of Classification Search
USPC ..... 439/352, 157, 258, 347
See application file for complete search history.

(56) References Cited

U.S. PATENT DOCUMENTS 6,430,053 B1 * 8/2002 Peterson et al. ..... 361/728
6,533,603 B1 * 3/2003 Togami ..... 439/372
6,592,398 B2 * 7/2003 Kashiyama et al. ..... 439/489
6,749,448 B2 * 6/2004 Bright et al. ..... 439/160
6,824,416 B2 11/2004 DiMascio
6,851,867 B2 2/2005 Pang et al.
6,884,097 B2 4/2005 Ice
6,908,323 B2 6/2005 Ice
7,033,204 B1 * 4/2006 Wang ..... 439/372
7,052,306 B2 5/2006 Ishigami et al.
7,083,336 B2 * 8/2006 Kim et al. ..... 385/92
7,090,523 B2 * 8/2006 Shirk et al. ..... 439/352
7,255,490 B2 * 8/2007 Zhang et al. ..... 385/88
7,422,457 B1 * 9/2008 Wu ..... 439/258
7,559,800 B2 * 7/2009 Wu ..... 439/607.3
7,566,246 B2 * 7/2009 Moore et al. ..... 439/607.01
7,690,939 B2 * 4/2010 Wu ..... 439/352
7,771,225 B1 * 8/2010 Wu ..... 439/352
7,841,887 B2 * 11/2010 Zhang et al. ..... 439/352
8,002,575 B2 * 8/2011 Li et al. ..... 439/465
8,064,207 B2 * 11/2011 Wu ..... 361/747
8,308,377 B2 * 11/2012 Yi ..... 385/92
2007/0117458 A1 * 5/2007 Winker et al. ..... 439/607

* cited by examiner

*Primary Examiner* — Amy Cohen Johnson
*Assistant Examiner* — Vladimir Imas
(74) *Attorney, Agent, or Firm* — Wei Te Chung; Ming Chieh Chang

(57) ABSTRACT

An electronic module (100) for mating with a complementary connector, comprises: a housing defining a recess area and a printed circuit board (3) disposed in the housing. A slider member is (61) assembled to an exterior surface of the housing and defining a pair of arm portions (612) formed on a front end thereof. And a gasket (5) is assembled to the recess area and defining a pair of curved portions (543) located above two free ends of the pair of arm portions. Whereby movement of the slider by a user along a front to rear direction, the two free ends of the pair of arm portions respectively raise up the pair of curved portions.

20 Claims, 6 Drawing Sheets

ELECTRONIC MODULE WITH IMPROVED LATCH MECHANISM

BACKGROUND OF THE INVENTION

1. Field of the Invention

The present invention generally relates to an electronic module, and more particularly to an electronic module having an improved latch mechanism for high speed signal transmitting.

2. Description of Related Art

SFP (Small Form-factor Pluggable), X-SFP and QSFP are all modules for fiber optic transmission or ordinary signal transmission. All of the modules are of small size or form factor which is important. The smaller the form factor of the module, the less space taken on a printed circuit board to which it couples. A smaller form factor allows a greater number of modules to be coupled onto a printed circuit board to support additional communication channels. However, the smaller form factor makes it more difficult for a user to handle. When such a module embedded in a system fails, it is desirable to replace it, particularly when other communication channels are supported by other modules. To replace a failed module, it needs to be pluggable into a module receptacle. While, plugging in a new module is usually easy, it is more difficult to remove the failed module because of other components surrounding it.

Therefore, designers developed different solutions to solve above problems accounted by the users, such as disclosed by U.S. Pat. Nos. 6,851,867, 6,749,448, 6,884,097, 6,908,323, 7,052,306, 6,824,416 and 7,090,523. The theories of theses patents are substantially the same, that is each module is received in corresponding cage or module receptacle and comprises a pair of sliders with forward ends engaging with tabs of the cage, and a bail or lever capable of rotating to actuate the sliders linearly to separate forward ends of the sliders from the tabs. The action theory of theses patents successfully solve the problems mentioned above. However, another problem is raised, that is there is not enough space left for operator's finger operation.

Hence, an improved electronic module is highly desired to overcome the disadvantages of the related art.

SUMMARY OF THE INVENTION

Accordingly, an object of the present invention is to provide an electronic module having an improved latch mechanism to be separated from a complementary connector expediently.

In order to achieve the object set forth, an electronic module for mating with a complementary connector, comprises: a housing defining a recess area; a printed circuit board disposed in the housing; a slider member assembled to an exterior surface of the housing and defining a pair of arm portions formed on a front end thereof; and a gasket assembled to the recess area and defining a pair of curved portions located above two free ends of the pair of arm portions; whereby movement of the slider by a user along a front to rear direction, the two free end of the pair of arm portions respectively raise up the pair of curved portions.

Other objects, advantages and novel features of the invention will become more apparent from the following detailed description when taken in conjunction with the accompanying drawings.

DETAILED DESCRIPTION OF THE INVENTION

Reference will now be made in detail to the preferred embodiment of the present invention.

Figure 1:
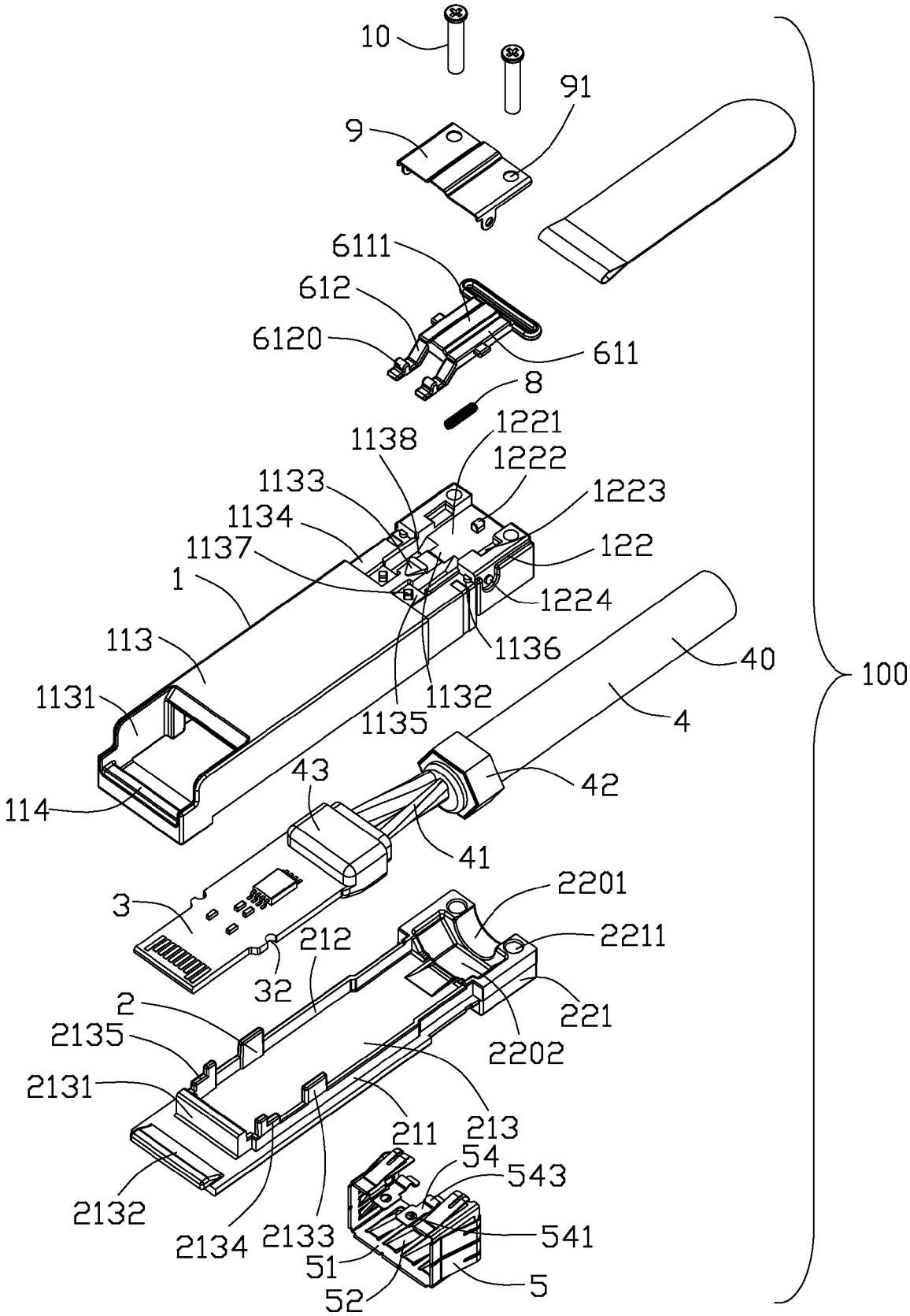
FIG. 1 is an exploded, perspective view of an electronic module in accordance with the present invention.
Figure 2:
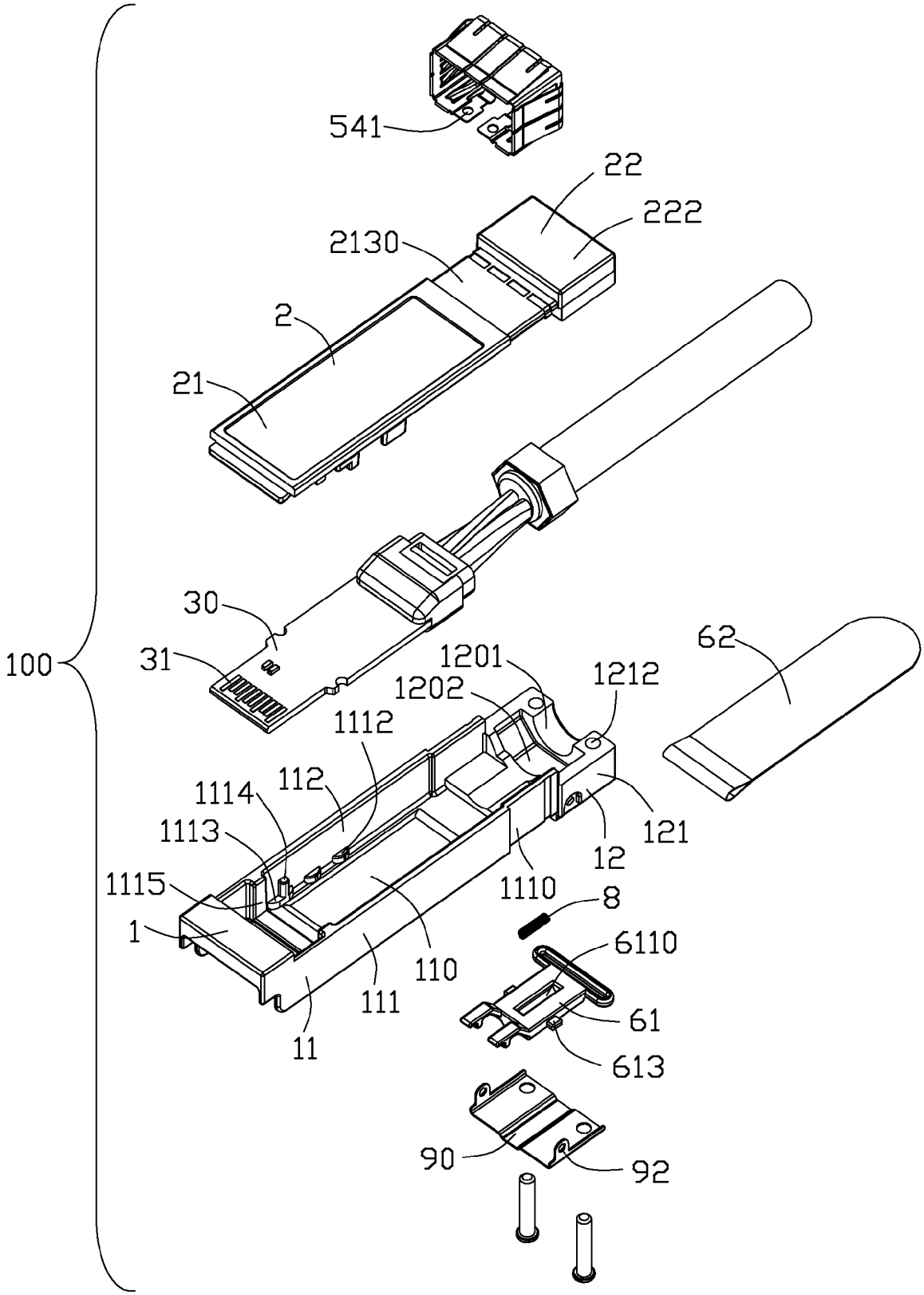
FIGS. 2-3 are other views similar to FIG. 1, but viewed from different aspects.
Figure 3:
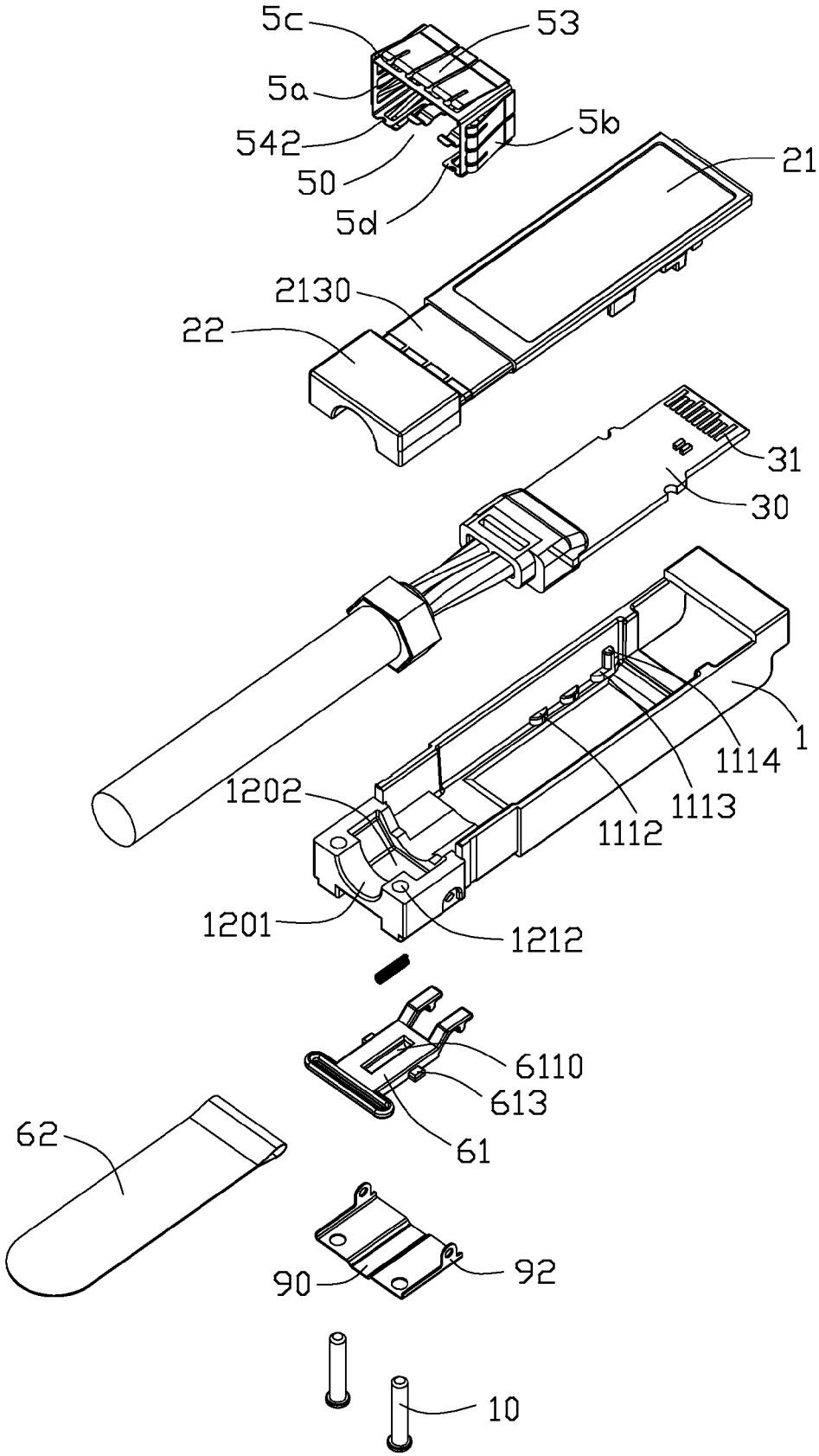

Referring to FIGS. 1-3, the electronic module 100 comprises a housing (not numbered) formed by a conductive base portion 1 and a conductive panel portion 2, a printed circuit board 3, a cable 4, a metallic gasket 5 and a latch mechanism (not numbered).

Referring to FIGS. 1-2, the base portion 1 is die-cast or other metallic plated body, and includes a primary body portion 11 and a first mounting portion 12 rearward extending from a back face of the primary body portion 11. The primary body portion 11 defines a recess area (not numbered) formed on an outer surface of rear portion thereof. The primary body portion 11 has a pair of lateral walls 111, 112 and a top wall 113 connecting with the lateral walls 111, 112 to form a receiving space 110 with an opening (not numbered) facing downward. Rear sections of the pair of the lateral walls 111, 112 define a pair of first depression portions 1110. An outlet 1131 is formed on a front section of the top wall 113. A rear section of the top wall 113 defines a first channel 1132 located in a middle area thereof. And, a locking piece 1133 is formed in the front and middle of the first channel 1132. A pair of sunken portions 1134 are formed on two lateral areas of the rear section of the top wall 113, and respectively arranged at two outer sides of the first channel 1132. A pair of indentations 1135 are respectively located at inner side of the corresponding sunken portions 1134. And each of the indentation 1135 is deeper than each of the sunken portion 1134. A pair of protrusions 1136 are respectively formed in a rear end of the two sunken portions 1134. A pair of tiny posts 1137 are respectively formed in the pair of indentations 1135. A pair of flutes 1138 are formed on two sides of the first channel 1132 and located on the rear section of the top wall 113. The two flutes 1138 are also respectively located at two inner sides of the two sunken portions 1134 and located behind the two indentations 1135. And, the flute 1138 is deeper than the indentation 1135.

The primary body portion 11 further has a beam portion 114 with substantially L-shaped cross-section interconnecting two front ends of the pair of the lateral walls 111, 112. The lateral walls 111, 112 of the primary body portion 11 respectively has two first standoffs 1112 and a second standoff 1113 located in front of the two first standoffs 1112 formed on an inner surface thereof. The two first standoffs 1112 and the second standoff 1113 are located adjacent to the outlet 1131 of the primary body portion 11. And a pair of wider ribs 1115 are respectively formed on two inner surfaces of the lateral walls 111, 112 and disposed in front of each second standoff 1113. Each second standoff 1113 has a situating post 1114 formed thereon. The situating post 1114 formed on the lateral wall 111 and the situating post 1114 formed on the lateral wall 112 are staggered with each other along a longitudinal direction.

The first mounting portion 12 has a pair of side walls 121 and a top wall 122. The first mounting portion 12 defines a first semi-circular cavity 1201 and a first position slot 1202 located in front of the first semi-circular cavity 1201. The first position slot 1202 is deeper than the first semi-circular 1201.

A second channel 1221 is formed on a middle area of the top wall 122 and communicated with the first channel 1132 of the primary body portion 11. A projection 1222 is formed in the second channel 1221 and located behind the locking piece 1133. A pair of guiding passages 1223 are formed on two lateral sides of the second channel 1221. And the first mounting portion 12 defines a pair of screw holes 1212 throughout the first mounting portion 12 along a vertical direction and respectively formed on two rear corners thereof. A pair of positioning posts 1224 are respectively formed on exterior surfaces of the pair of side walls 121.

The panel portion 2 is die-cast or a metallic plated body. The panel portion 2 comprises a secondary body portion 21 and a second mounting portion 22 extending rearwards from a back face of the secondary body portion 21. The secondary body portion 21 has a planar board member 213 and a pair of flange members 211, 212 formed on two lateral sides thereof. The board member 213 defines a second depression portion 2130 formed on an outer surface thereof and a vertical wall 2131 perpendicular to the pair of flange members 211, 212 and interconnected with two front ends of the pair of flange members 211, 212. The two flange members 211, 212 respectively defines two supporting post 2133 extending upward from thereon. Four supporting posts 2133 are located behind the vertical wall 2131. A front supporting post 2133 of the two supporting posts 2133 of the flange member 211 has a first aperture 2134 opening facing rearwardly. And a front supporting post 2133 of the two supporting posts 2133 of the flange member 212 has a second aperture 2135 opening facing forwardly. That is to say, the first aperture 2134 and the second aperture 2135 have opposite facing directions with each other. The board member 213 has a protrusion portion 2132 formed on a front end thereof.

The second mounting portion 22 also has a pair of side walls 221 and a bottom wall 22. The second mounting portion 22 defines a second semi-circular cavity 2201 and a second position slot 2202 located in front of the second semi-circular cavity 2201. And the second mounting portion 12 defines a pair of through holes 2211 throughout the second mounting portion 12 along a vertical direction and respectively formed on two rear corners thereof. The recess area is formed by the first depression portions 1110 and the second depression portions 2130.

The printed circuit board 3 includes a substrate 30, a plurality of first conductive pads 31 formed on two opposite surfaces of a front section of the substrate 30 and a plurality of second conductive pads (not shown) located on a rear section thereof. A pair of semi-circular positioning holes 32 are disposed in both sides of a front segment of the substrate 30. And, the two positioning holes 32 are not in alignment with each other along a transversal direction. That is to say, the two positioning holes 32 are staggered with each other along a longitudinal direction. The shape of the positioning hole 32 also can be defined by other configurations, such as square.

The cable 4 includes an outer insulative jacket 40 and a number of wires 41 enclosed by the insulative jacket 40. And a number of wires 41 are insulated with each other. A cable holder member 42 is attached to the cable 4 and surrounds a front portion of the cable 4. The cable holder member 42 is adjacent to the exposed wires 41. A front section of the wires 41 are electrically connected with the second conductive pads of the printed circuit board 3. And, an insulator 43 is formed around a connection between a front section of the wires 41 and the printed circuit board 3.

The gasket 5 is made of metal sheet and has a rectangular-shaped frame portion 51. The frame portion 51 defines a pair of vertical sides 5*a*, 5*b*, a lower side 5*c* connecting with the pair of vertical sides 5*a*, 5*b*, and a pair of upper walls 5*d* respectively extending inwardly from two top ends of the pair of vertical walls 5*a*, 5*b*. An outlet 50 is formed between the pair of upper walls 5*d* for the gasket 5 easily assembling to the housing. A number of detents 52, 53 formed on the frame portion 51 are divided into a layer of first detents 53 and a layer of second detents 52. A number of first detents 53 are located on an outer side of the frame portion 51. A number of second detents 52 are located on an inner side of the frame portion 51. A number of second detents 52 are shielded by a number of first detents 53 to achieve better Electro-Magnetic Interference (EMI) suppressing effect. A number of first detents 53 extend rearward and outward from front edge of the frame portion 51. And a number of second detents 52 are stamped from the frame portion 51 and extend rearward and outward.

A pair of fixing portions 54 are respectively formed on free ends of the pair of upper walls 5*d* and extend into the outlet 50. Each fixing portion 54 has a circular hole 541 in a central area thereof. Each upper wall 5*d* has a semi-circular cutout 542 located in a distal end thereof to cooperate with two corresponding protrusions 1136 located in the two sunken portions 1134. Each fixing portion 54 has a curved portion 543 formed on a rear section thereof to cooperate with a protrudent portion 6120. As a result, the protrudent portion 6120 is covered by the curved portion 543.

The latch mechanism includes a slider member 61 and a pull tape 62. The slider member 61 has a substantially rectangular shaped body portion 611 and two arm portions 612 extending forwardly from a front face of the body portion 611. The two arm portions 612 are made of plastic material and spaced apart with each other along a transversal direction. And, the two arm portions 612 are respectively received into the corresponding flutes 1138. The body portion 611 has a groove 6110 formed on a bottom surface thereof and extending along a front to rear direction. The body portion 611 defines a bar 6111 formed on a top surface thereof and extending along a front to rear direction. The projection 1222 is received into the groove 6110 when the slider member 61 is assembled to the base portion 1. Each arm portion 612 has a protrudent portion or urging section 6120 extending upwardly. And the body portion 611 defines a pair of tubers 613 formed on lateral sides thereof and respectively received into the two guiding passages 1223. The slider member 61 can be moved along a front to rear direction.

The pull tape 62 is a soft belt with a certain width. The pull tape 62 defines a connecting end attached to the slider member 61 and a handling portion 621 for operator pulling the latch mechanism.

A spring 8 is received into the groove 6110 and located in front of the projection 1222.

A metallic member 9 is made of metal sheet and defines a notch 90 extending along a front to rear direction to cooperated with the bar 6111 and a pair of openings 91 formed on two sides of the notch 90. The metallic member 9 further defines a pair of connecting portions 92 on lateral sides thereof. The pair of openings 91 are formed in rear segment of the metallic member 9. And the pair of connecting portions 92 are formed at two sides of a front section of the metallic member 9. The two connecting portions 92 are respectively received into the two semi-circular holes of the base portion 1 and engaged with the two positioning posts 1224.

Figure 4:
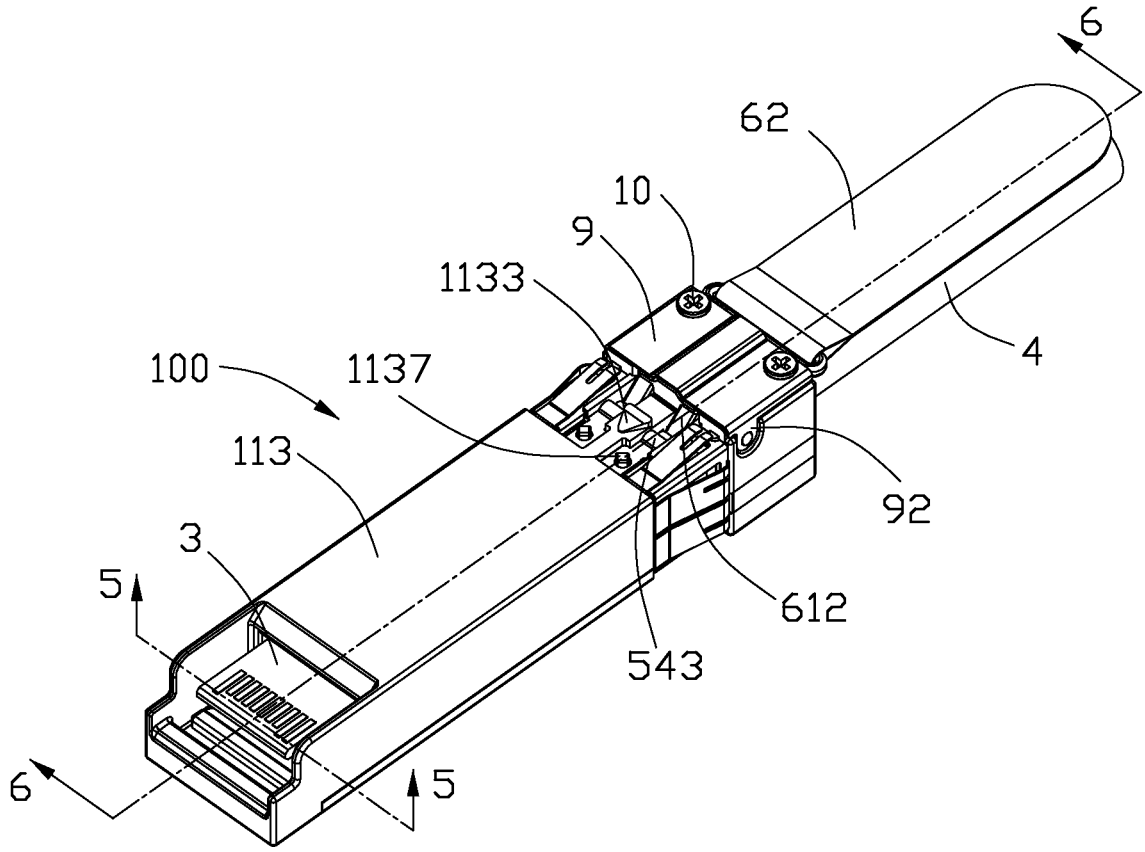
FIG. 4 is an assembled, perspective view of the electronic module shown in FIG. 1.
Figure 5:
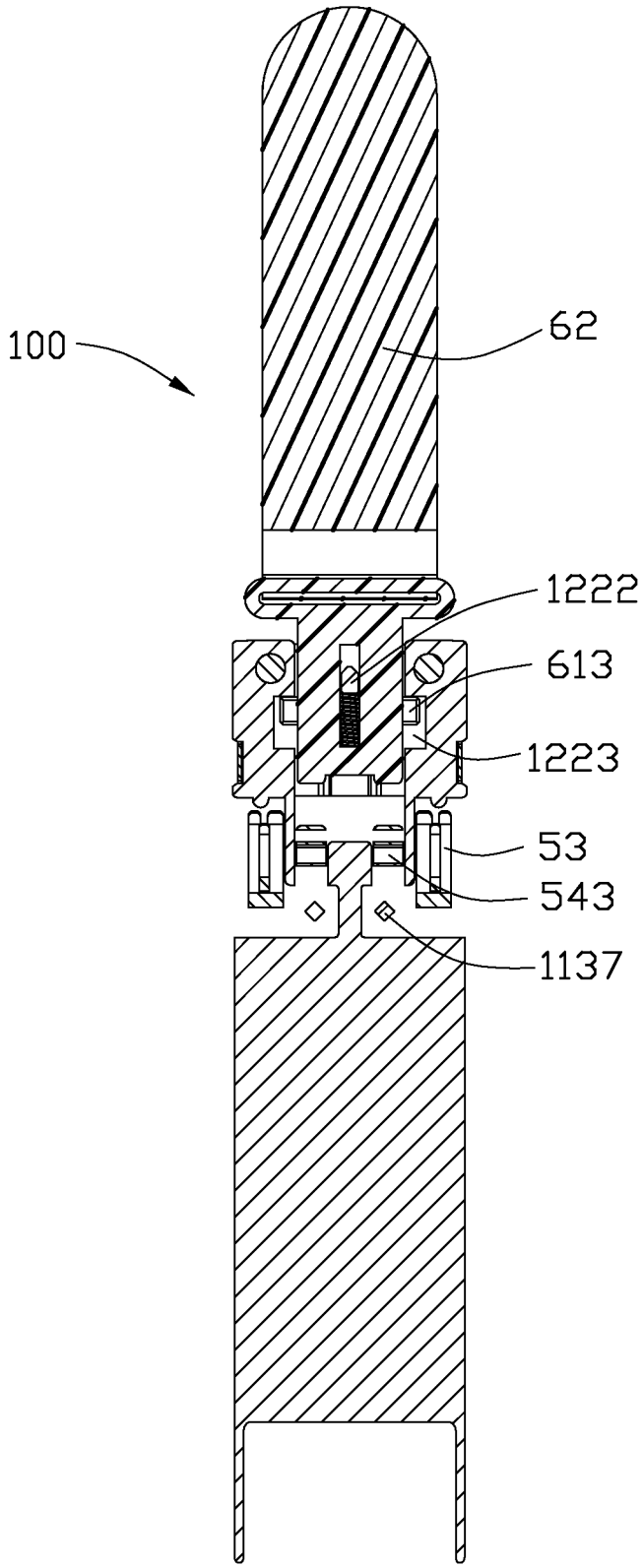
FIGS. 5-6 are cross-section views taken along lines 5-5 to 6-6 of FIG. 4.
Figure 6:
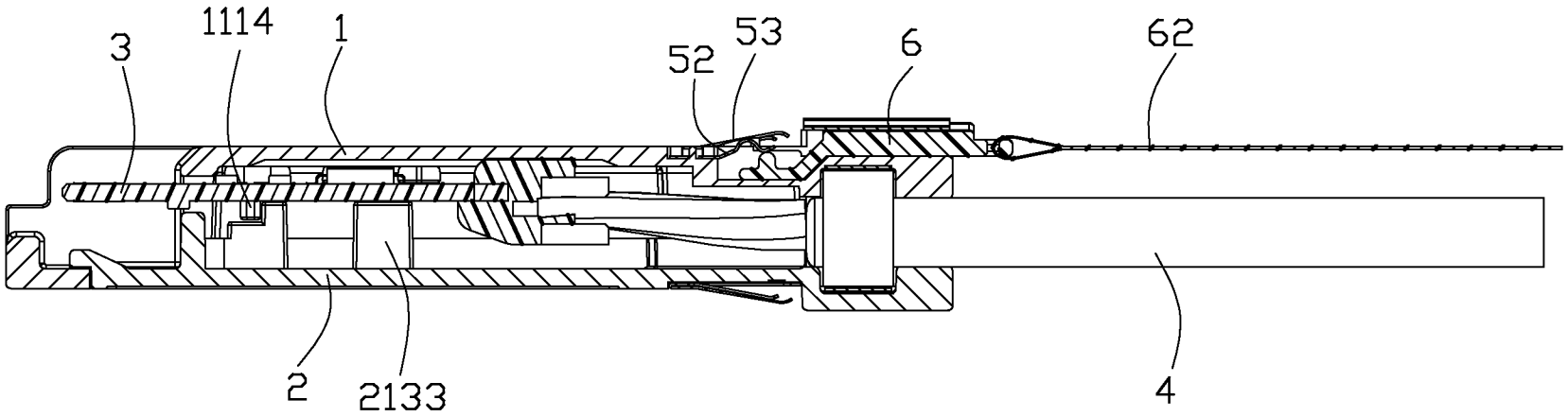

Referring to FIGS. 1-3, in conjunction with FIGS. 4-6, in assembly, the insulative jacket 40 of a front segment of the cable 4 is decorticated. And, then the wires 41 are exposed outside and soldered to the second conductive pads of the printed circuit board 3. And an insulator 43 is formed around a connecting portion between the wires 41 and the printed circuit board 3.

The printed circuit board 3 is assembled into the base portion 1 and received in the receiving space 110 of the base portion 1. Simultaneously, the printed circuit board 3 is located on the first standoffs 1112 and the second standoffs 1113 of the base portion 1. And the situating posts 1114 are inserted into the positioning holes 32 of the printed circuit board 3 to position the printed circuit board 3 to the base portion 1.

The cable holder member 42 of the cable 4 is partially received into the first position slot 1202 of the base portion 1. The panel portion 2 is assembled to the base portion 1 and has a pair of lateral flange members 211, 212 extending into the receiving space 110. The supporting posts 2133 attach to a bottom surface of the printed circuit board 3. The two situating posts 1114 are received into the first and second apertures 2134, 2135. As the first and second apertures 2134, 2135 have different opening facing directions. So the panel portion 2 is positioned with the base portion 1 along a front to rear direction. The protrusion portion 2132 of the panel portion 2 is received into the beam portion 114 of the base portion 1. The cable holder member 42 is totally received into the first and second position slot 1202, 2202.

The slider member 61 is assembled into the second the second channel 1221 of the first mounting portion 12. The pair of tubers 613 are respectively received into the two guiding passages 1223. The two arm portions 612 of the slider member 61 are received into the pair of flutes 1138. The spring 8 is received into the groove 6110 of the slider member 61 and disposed in front of and abutted against the projection 1222. The spring 8 will be compressed when the slider member 61 moves rearwardly. The spring 8 will be resumed to an original state when an exerting force is released.

The gasket 5 surrounds the rear out surface of the housing (not figured). The pair of vertical sides 5*a*, 5*b* are received into the pair of first depression portions 1110. The lower side 5*c* is received into the second depression portions 2130 of the panel portion 2. The pair of fixing portions 54 are respectively received into the pair of indentations 1135. The tiny post 1137 formed in the indentation 1135 is passed through the circular hole 541. Thus, the gasket 5 is fixed to the housing. The pair of protrusions 1136 are received into the pair of semi-circular cutouts 542 of the upper wall 5*d*. The protrudent portion 6120 of the arm portion 612 is disposed below the curved portion 543 of the fixing portion 54 of the gasket 5.

The metallic member 9 is assembled to a top surface of the first mounting portion 12 and covered to the body portion 611 of the slider member 61. The bar 6111 of the body portion 611 is received into the notch 90. The pair of connecting portions 92 are cooperated with the pair of positioning posts 1224. The opening 91, the screw hole 1212, the through hole 2211 are in alignment with each other along a vertical direction. A pair of screws 10 are respectively passed through the opening 91, the screw hole 1212, the through hole 2211 to engage with the metallic member 9, the base portion 1 and the panel portion 2 together.

While the electronic module 100 disengaging away from the complementary connector, just exert a pulling force on the handling portion 621 of the pull tape 62 to promote the slider member 61 moving rearwardly. Thus, each curved portion 543 is raised up due to the protrudent portion 6120 rearward movement. As a result, the cage of the complementary connector is moved outwards to allow the electronic module 100 depart from the complementary connector.

It is to be understood, however, that even though numerous characteristics and advantages of the present invention have been set forth in the foregoing description, together with details of the structure and function of the invention, the disclosure is illustrated only, and changes may be made in detail, especially in matters of shape, size, and arrangement of parts within the principles of the invention to the full extent indicated by the broad general meaning of the terms in which the appended claims are expressed.

What is claimed is:

1. An electronic module for mating with a complementary connector, comprising:

a housing defining a recess area;

a printed circuit board disposed in the housing;

a slider member assembled to an exterior surface of the housing and defining a pair of arm portions formed on a front end thereof; and a gasket assembled to the recess area and defining a pair of curved portions located above two free ends of the pair of arm portions;

whereby movement of the slider by a user along a front to rear direction, the two free end of the pair of arm portions respectively raise up the pair of curved portions.

2. The electronic module as claimed in claim 1, wherein the electronic module further comprises a pull tape attached to a rear end of the slider member for the user operating.

3. The electronic module as claimed in claim 1, wherein the electronic module further comprises a cable electrically connected to a rear end of the printed circuit board.

4. The electronic module as claimed in claim 1, wherein the electronic module further comprises a metallic member assembled to the housing and covering a portion of the slider member.

5. The electronic module as claimed in claim 4, wherein the housing comprises a base portion and a panel portion assembled with each other along a vertical direction, the printed circuit board is sandwiched between the base portion and the panel portion.

6. The electronic module as claimed in claim 5, further comprising a pair of screws interconnecting with the metallic member, the base portion and the panel portion.

7. The electronic module as claimed in claim 1, wherein the housing defines a locking piece formed on the exterior surface and disposed between the two arm portions of the slider member along a transversal direction for locking with a cage of the complementary connector.

8. The electronic module as claimed in claim 1, wherein the gasket defines two fixing portions engaged with the housing, the pair of curved portions are respectively formed on a rear end of the two fixing portions.

9. The electronic module as claimed in claim 8, wherein the gasket defines a number of first detents located on an outer side thereof and a number of second detents located on an inner side thereof.

10. The electronic module as claimed in claim 1, wherein the slider member defines a groove formed on a bottom surface thereof, a spring is received into the groove and abutted against a projection formed the exterior surface and received into the groove.

11. An electronic module, comprising:

a housing defining a recess area formed on an outer surface thereof;

a printed circuit board disposed in the housing;

a latch mechanism assembled to an exterior surface of the housing, the latch mechanism comprising a slider member and a pull tap connected to a rear end of the slider member, the slider member further defining a body portion and a pair of arm portions extending forwardly and downward from the body portion; and a gasket assembled to the recess area and defining a pair of fixing portions engaged to the housing, the pair of fixing portions comprising two curved portions located above two free ends of the pair of arm portions;

whereby when the slider member is pulled, said slider member deflects two rear ends of the two curved portions vertically.

12. The electronic module as claimed in claim 11, wherein the housing comprises a base portion and a panel portion assembled with each other, the electronic module further comprises a metallic member covering the body portion of the slider member.

13. The electronic module as claimed in claim 12, wherein the electronic module further comprises a pair of screws interconnecting the metallic member, the base portion and the panel portion together.

14. The electronic module as claimed in claim 11, wherein the slider member defines a groove formed on a bottom surface thereof, a spring is received into the groove and abutted against a projection formed the exterior surface and received into the groove.

15. The electronic module as claimed in claim 11, wherein the electronic module further comprises a cable electrically connected to a rear end of the printed circuit board.

16. The electronic module as claimed in claim 11, wherein a pair of protrudent portions are respectively formed on two free ends of the pair of arm portions and cooperated with the two curved portions of the gasket.

17. An electrical module comprising:

a housing defining a mating port forwardly communicating with an exterior in a front-to-back direction;

a locking piece formed on an exterior surface of the housing for locking;

a slider member assembled to the housing and back and forth moveable along the front-to-back direction and equipped with an urging section; and a gasket attached to the housing and defining a fixing portion with a ramp thereof in confrontation with the urging section; wherein via rearward movement of the slider member in the front-to-back direction, the urging section pushes the ramp outwardly so as to have the fixing portion outwardly deflected in a transverse direction perpendicular to said front-to-back direction to unlock the electrical module.

18. The electrical module as claimed in claim 17, wherein the urging section is a protruding piece bulged in said transverse direction.

19. The electrical module as claimed in claim 18, wherein the fixing portion defines a recess located beside the ramp in the front-to-back direction and offset in the transverse direction to receive the protruding piece.

20. The electrical module as claimed in claim 17, wherein said slider member is equipped with a spring to urge the slider member forwardly.

* * * * *